US007669842B2

(12) United States Patent
Smith

(10) Patent No.: US 7,669,842 B2
(45) Date of Patent: Mar. 2, 2010

(54) SHEET ROTATOR

(75) Inventor: Wayne R. Smith, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 561 days.

(21) Appl. No.: 11/507,841

(22) Filed: Aug. 22, 2006

(65) Prior Publication Data

US 2008/0048386 A1 Feb. 28, 2008

(51) Int. Cl.
*B65H 37/04* (2006.01)

(52) U.S. Cl. ..... 270/58.07; 270/32; 270/37; 270/58.08

(58) Field of Classification Search ..... 270/32, 270/37, 58.07, 58.08; 271/184, 185
See application file for complete search history.

(56) References Cited

U.S. PATENT DOCUMENTS 4,653,744 A 3/1987 Poehler et al.
4,724,945 A 2/1988 Martin
4,727,402 A 2/1988 Smith
4,733,857 A 3/1988 Feldeisen et al.
4,756,521 A 7/1988 Martin
4,830,356 A 5/1989 Zoltner
4,877,234 A 10/1989 Mandel
4,927,133 A 5/1990 Evans
5,090,683 A 2/1992 Kamath et al.
5,931,462 A 8/1999 Delfosse
6,059,285 A * 5/2000 Suga et al. ..... 271/228
6,811,152 B2 * 11/2004 Delfosse et al. ..... 271/225
2005/0212194 A1 * 9/2005 Moriyama et al. ..... 270/58.08

OTHER PUBLICATIONS

U.S. Appl. No. 11/180,817, filed Jul. 13, 2005 and entitled Compact Booklet Maker by Raymond M. Ruthenberg et al.

* cited by examiner

*Primary Examiner*—Gene Crawford
*Assistant Examiner*—Leslie A Nicholson, III

(57) ABSTRACT

A sheet turning apparatus includes a vacuum source used to capture and hold a sheet onto a rotatable disc that is connected to a servo motor. Actuation of the servo motor causes rotation of the disc which in turn rotates the sheet 90°.

5 Claims, 12 Drawing Sheets

SHEET ROTATOR

CROSS REFERENCE TO RELATED APPLICATION

Cross referenced is and commonly assigned U.S. application Ser. No. 11/180,817 filed Jul. 13, 2005 and entitled COMPACT BOOKLET MAKER by Raymond M. Ruthenberg et al, now U.S. Pat. No. 7,293,766.

This invention relates in general to an image forming apparatus, and more particularly, to an image forming apparatus employing an improved sheet rotator for rotating sheets 90° within their plane of travel.

In some current printing systems, sheet output is delivered in the long edge first direction ("portrait" orientation). One reason for this is the increase in productivity that is obtained by feeding sheets long edge first. However, this may preclude on-line finishing since some on-line finishing requires the sheets to be short edge fed ("landscape" orientation) into the finisher. For example, in order to perform standard letter folds using a buckle folder, copy sheet must be fed to the folder short edge first. Since the output from most copiers and electronic printers is long edge first, some type of sheet turning mechanism is necessary if folding is to be done in an on-line, straight-line system.

Sheet rotation is fast becoming a highly sought after capability to enable the connection of third party finishing devices (i.e., folders, direct mail systems, etc.) to pre-existing copiers and printers. It is common for finishing devices such as, for example, buckle folders, saddle stitchers, direct mail systems, compiler/staplers, and the like, to require documents to be input with their short edge first. However, is also common for copiers and printers to output documents with their long edge first. Thus, a document rotation device is needed to rotate documents 90° between the output of the copier or printer and the input of the finishing device.

One example of a present sheet turner includes U.S. Pat. No. 4,830,356 which discloses a passive pinwheel copy sheet rotator in the form of a disc that rotates copy sheet 90° or 180°. The disc had four quadrants and is used in conjunction with a ball-on-belt registration system. As a sheet comes into contact with a quadrant of the disc, the sheet is stopped and a non-contacting side of the sheet rotates due to the ball-on-belt transport. Another sheet turning device is shown in U.S. Pat. No. 4,877,234 in which sheets are separately driven by two rolls. For sheet turning, one of the rolls is stopped while the other continues to drive and rotate the sheet. An angled conveyor for document packages is shown in U.S. Pat. No. 4,927,133. A post extends from the conveyor which contacts a package to force the package to rotate around the post 90°. In U.S. Pat. No. 4,756,521 an apparatus for turning flat articles includes a rotating device which steers the articles in a preselected direction. U.S. Pat. No. 4,724,945 discloses an apparatus for turning flat articles that includes a rotating device having first and second pairs of rollers which steer the articles in a preselected direction. U.S. Pat. No. 4,653,744 discloses a device for transferring flat objects between two stations at an obtuse angle. A transport mechanism is located at the narrowest side of the gap for transporting the objects and rotating them around the obtuse angle. A copier is disclosed in U.S. Pat. No. 4,733,857 where sheets exit the copier processing station in a horizontal plane, are turned 90° while still in the plane, are transported upwardly in a vertical plane, and deposited in sorter trays which extend toward the operator. In U.S. Pat. No. 5,931,462 in order to produce a desired sheet orientation between upstream and downstream positions of a sheet path along which sheets travel successively in a predetermined sheet travel direction, each sheet is driven uniformly along the path with an intermediate phase in which the sheet is driven differentially to rotate the sheet without changing its velocity component in the sheet travel direction. If the sheet has skew or an offset error, the amount of rotation and its starting point are adjusted appropriately to compensate for both. A device for selectively turning documents is shown in U.S. Pat. No. 5,090,683 that includes first and second drive rollers with one of the drive rollers being operated at a substantially constant peripheral velocity by a first operation means while the other drive roller is operated at a variable peripheral velocity by a second operating means so that the document is turned. The heretofore-mentioned patents are incorporated herein by reference. While the above-mentioned sheet turning derives will rotate sheets sufficiently, some are bulky, some are cumbersome, some are costly and some suffer from unreliability due to paper thickness, curl, temperature, image scuffing, and wear and tare of mechanical servo mechanisms.

Obviously, it would be advantageous to have a sheet rotator system that provides increased reliability and durability.

Accordingly, as an example, an improved sheet rotator system and method is disclosed that includes the use of a vacuum assembly and rotation mechanism to acquire a 90° (or similar) rotation during paper feeding. A servo motor or similar device provides rotation to the vacuum assembly after the sheet has been acquired.

The disclosed reprographic system that incorporates the disclosed vacuum assembly and rotation mechanism may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
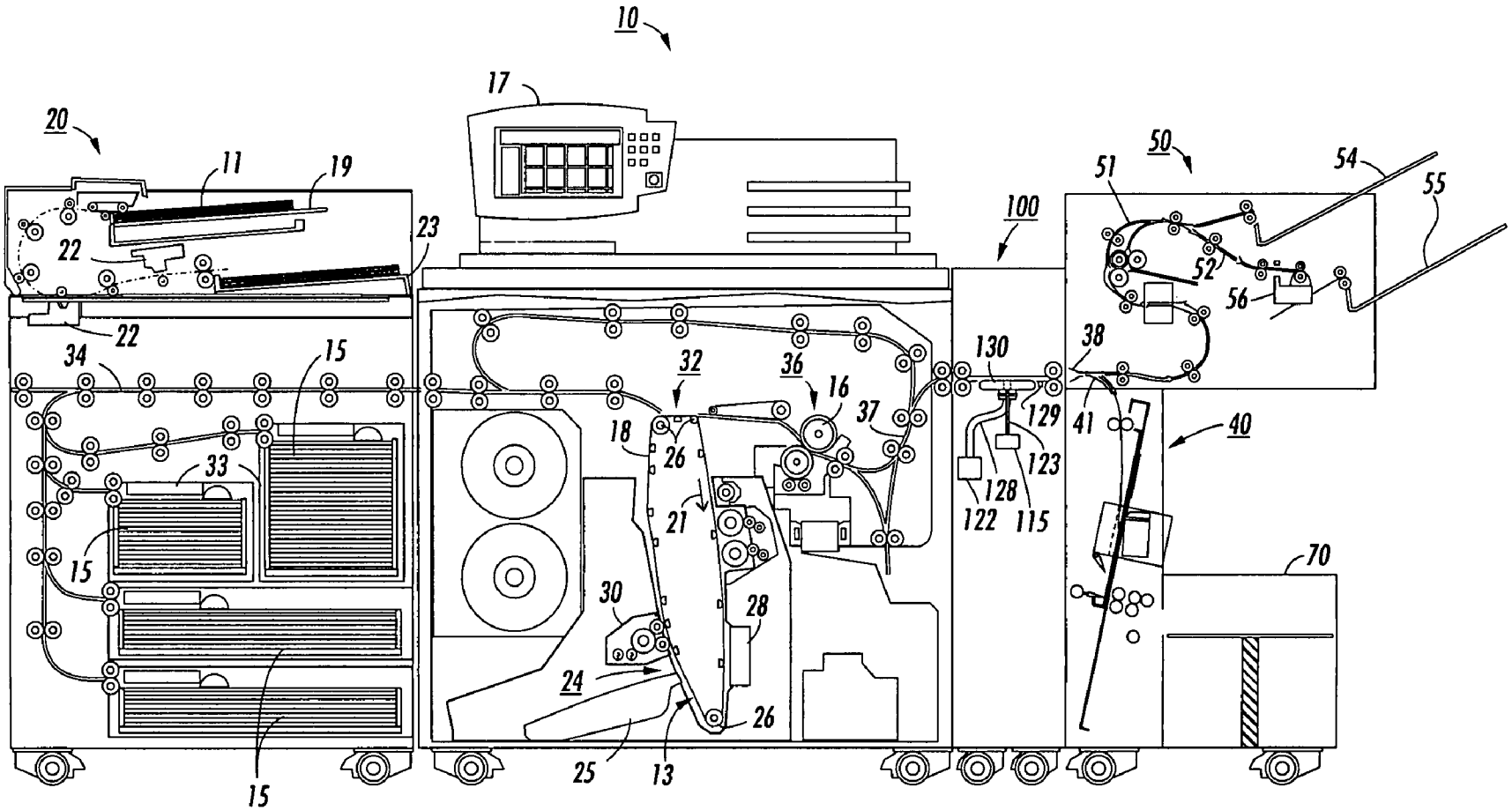
FIG. 1 is an exemplary elevation view of a modular xerographic printer that includes an exemplary modular vacuum rotation system in accordance with the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes an improved vacuum sheet rotator.

For a general understanding of the features of the disclosure, reference is made to the drawings. In the drawings, like reference numerals have been used throughout to identify identical elements.

Referring to the FIG. 1 printer 10, as in other xerographic machines, as is well known, an electronic document or an electronic or optical image of an original document or set of documents to be reproduced may be projected or scanned onto a charged surface 13 or a photoreceptor belt 18 to form an electrostatic latent image. Optionally, an automatic document feeder 20 (ADF) may be provided to scan at a scanning station 22 paper documents 11 fed from a tray 19 to a tray 23. The latent image is developed with developing material to form a toner image corresponding to the latent image. The toned image is then electrostatically transferred to a final print media material, such as, paper sheets 15, to which it may be permanently fixed by a fusing device 16. The machine user may enter the desired printing and finishing instructions through the graphic user interface (GUI) or control panel 17, or, with a job ticket, an electronic print job-description from a remote source, or otherwise.

As the substrate passes out of the nip, it is generally self-stripping except for a very lightweight one. The substrate requires a guide to lead it away from the fuser roll. After separating from the fuser roll, the substrate is free to move along a predetermined path toward the exit of the printer 10 in which the fuser structure apparatus is to be utilized.

The belt photoreceptor 18 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and transfer station 32. A sheet 15 is fed from a selected paper tray supply 33 to a sheet transport 34 for travel to the transfer station 32. Paper trays 33 include trays adapted to feed the long edge of sheets first from a tray (LEF) or short edge first (SEF) in order to coincide with the LEF or SEF orientation of documents fed from tray 11 that is adapted to feed documents LEF or SEF depending on a user's desires. Transfer of the toner image to the sheet is affected and the sheet is stripped from the photoreceptor and conveyed to a fusing station 36 having fusing device 16 where the toner image is fused to the sheet. The sheet 15 is then transported by a sheet output transport 37 to a multi-function finishing station 60. Fusing energy is removed from the sheet by conventional means (not shown) before it reaches vacuum sheet rotator 100 since the paper, during a long run on higher speed printers, can be in a 'plastic' or non-equilibrated state with a very reduced beam strength. The paper can be dynamically changing creating a higher than desired jam rate or poorly stacked sheets and cooler sheets are less prone to image marking.

Figure 2:
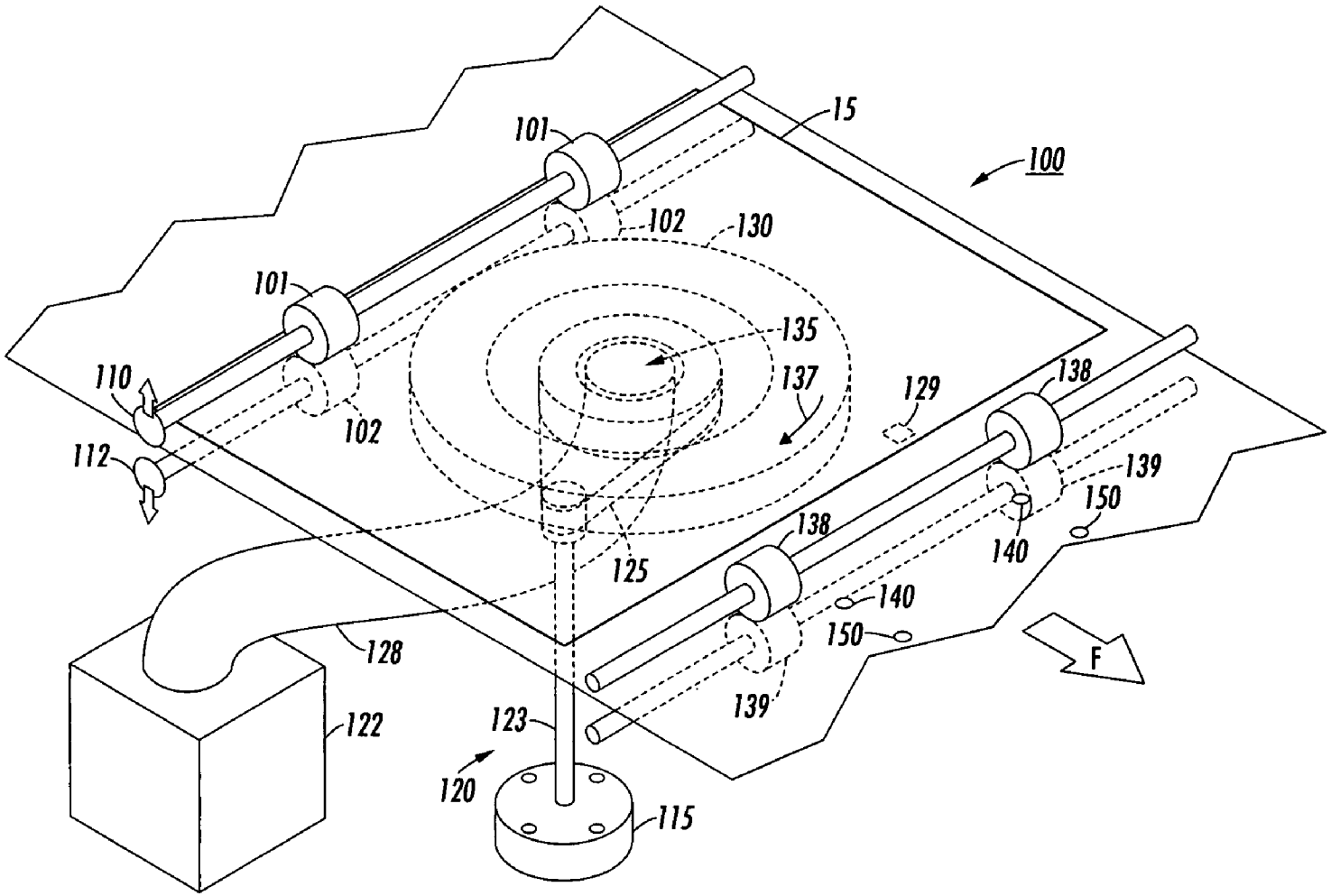
FIG. 2 is a partial perspective view of the vacuum rotation system in accordance with the present disclosure showing a sheet being fed long edge first.
Figure 3:
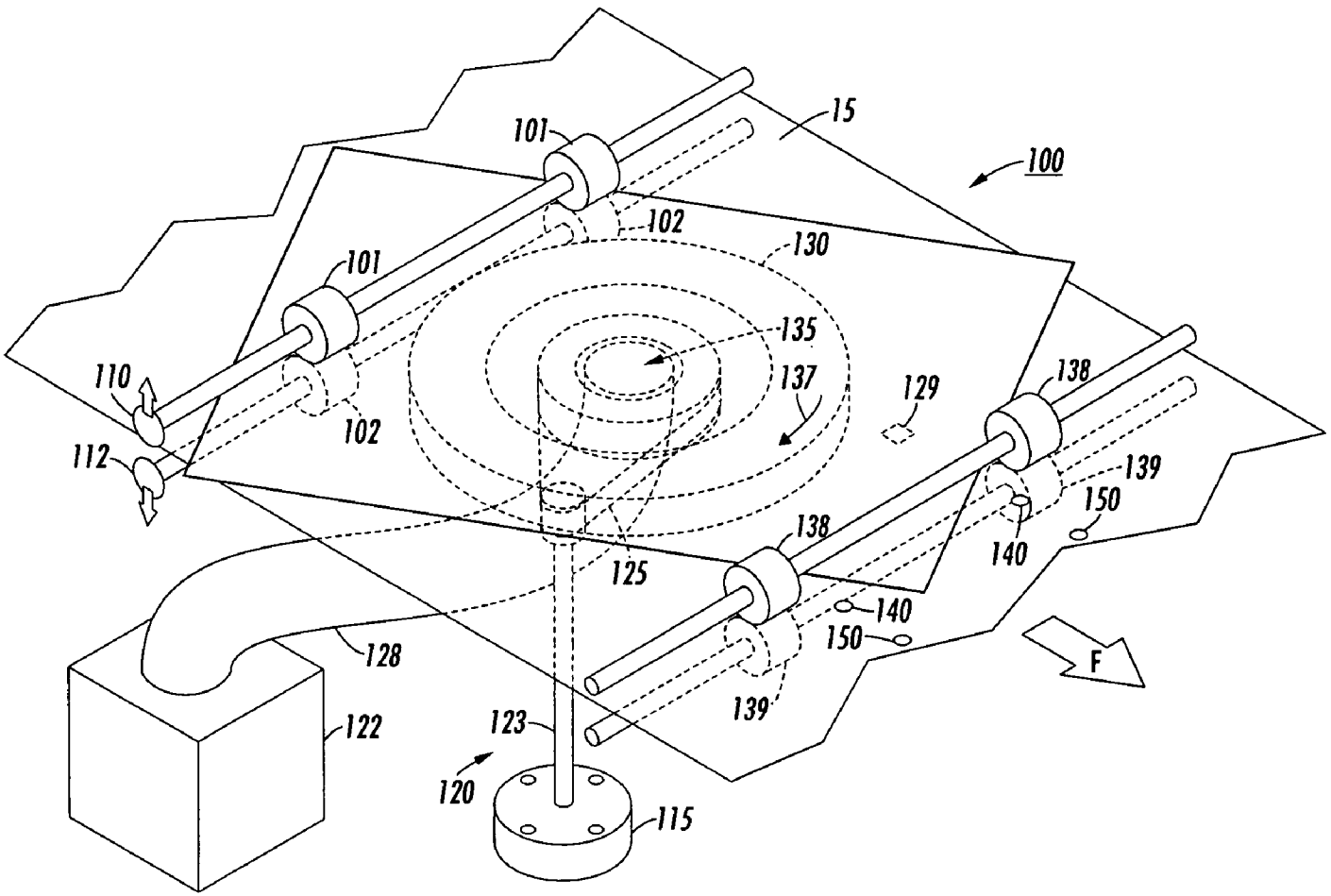
FIG. 3 is a partial perspective view of the vacuum rotation system of FIG. 2 showing the sheet being rotated clockwise.
Figure 4:
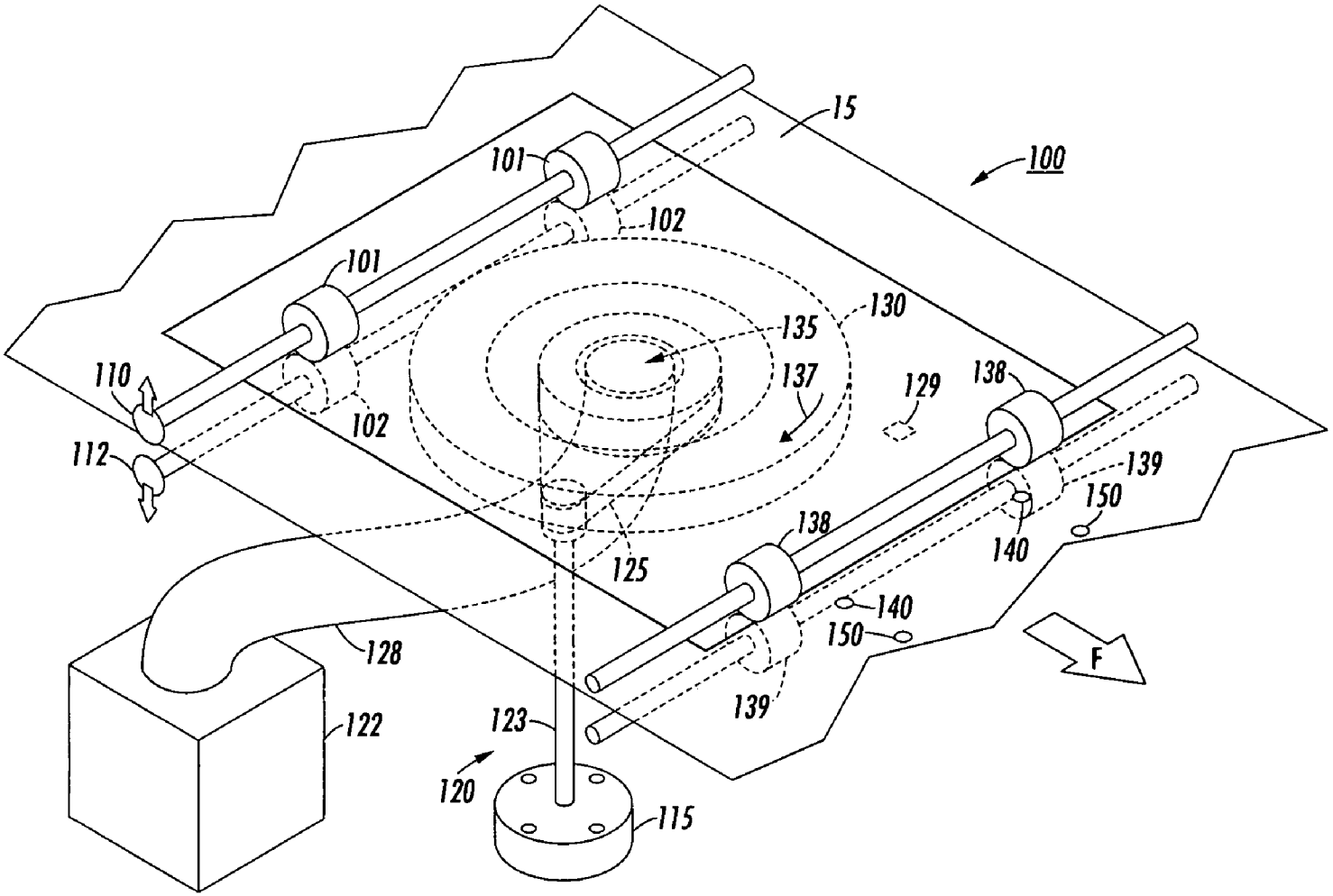
FIG. 4 is a partial perspective view of the vacuum rotation system of FIG. 2 showing the sheet rotated 90° clockwise.

With further reference to FIG. 1, and the present disclosure, a modular vacuum sheet rotator system 100 is shown positioned between the image processor 10 and booklet maker 40. When booklet making is requested at console 17 and sheets are fed long edge first (portrait) into processor 10, the rotator system 100 is actuated to rotate incoming sheets 90°, as shown in FIGS. 2-4, in order to present the sheets to booklet maker 40 short edge (landscape) first. As seen in FIG. 2, a sheet 15 is conveyed by drive nips formed between drive rolls 101 and idler rolls 102 towards sheet rotator 120. When the sheet passes sensor 129, vacuum pressure is presented by vacuum source 122 to the sheet through conduit 128 and vacuum capture port 135 where the sheet is drawn onto rotatable disc 130. It should be understood that multiple vacuum ports could be used to capture the sheet, if desired. In addition, the vacuum can be changed to accommodate light weight or heavy weight sheets, porous or non-porous, and large or small sheets by using a conventional closed loop control that dynamically senses sheet rotation performance by sheet basis. Simultaneously, solenoids 110 and 112 are actuated to provide nip release between nips 101, 102 along with servo 115 that rotates shaft 123 which in turn drives belt 125 that rotates disc 130 in the direction of arrow 137. Nips 101 and 102 are velocity controlled to minimize jerk to the sheet as it is stopped and started in order to prevent scuffing marks, jams or sloppy sheet positioning. With sheet 15 now being vacuum attached to rotatable disc 130, the sheet is then rotated in FIGS. 3 and 4 by 90°.

After rotation, the sheet is captured by driver roll nips 138, 139 and as the trail edge of the sheet passes sensor 129 drive rolls 101, 102 are brought back into contact to convey an incoming sheet. Sensors 140 are used to sense the lead edge and determine the input skew of each sheet and sensors 150 are used to sense the trail edge of the sheet to determine the output skew of the sheet for correction by conventional mechanisms, if necessary. A conventional cut-off valve (not shown) is included in the vacuum sheet rotator system for vacuum release purposes.

With printer 10 enabling electronic image and text imposition and pagination of documents, long edge first (LEF) feeding is enabled and thereby yielding highly efficient use of the photoreceptor. In addition, with book making desired, enabling short edge feeding of sheets (SEF) allows the sheets to be printed with the grain of the paper the book spine to enhance folding of the sheets into a lay-flat book.

Also in FIG. 1, a simplified elevation view of a multi-functional finisher 50 is shown including a modular booklet maker 40. Printed signature sheets from the printer 10 are accepted at an entry port 38 and directed to multiple paths and output trays for printed sheets, corresponding to different desired actions, such as stapling, hole-punching and C or Z-folding. It is to be understood that various rollers and other devices which contact and handle sheets within finisher module 50 are driven by various motors, solenoids and other electromechanical devices (not shown), under a control system, such as including a microprocessor (not shown), within the finisher module 50, printer 10, or elsewhere, in a manner generally familiar in the art.

Multi-functional finisher 50 has a top tray 54 and a main tray 55 and a folding and booklet making section 40 that adds stapled and unstapled booklet making, and single sheet C-fold and Z-fold capabilities. The top tray 54, is used as a purge destination, as well as, a destination for the simplest of jobs that require no finishing and no collated stacking. The main tray 55 has a pair of pass-through 100 sheet upside down staplers 56 and is used for most jobs that require stacking or stapling, and the folding destination 40 is used to produce signature booklets, saddle stitched or not, and tri-folded. Sheets that are not to be C-folded, Z-folded or made into booklets or do not require stapling are forwarded along path 51 to top tray 54. Sheets that require stapling are forwarded along path 52, stapled with staplers 56 and deposited into the main tray 55. Conventional, spaced apart, staplers 56 are adapted to provide individual staple placement at either the inboard or outboard position of the sheets, as well as, the ability for dual stapling, where a staple is placed at both the inboard and outboard positions of the same sheets.

Figure 5:
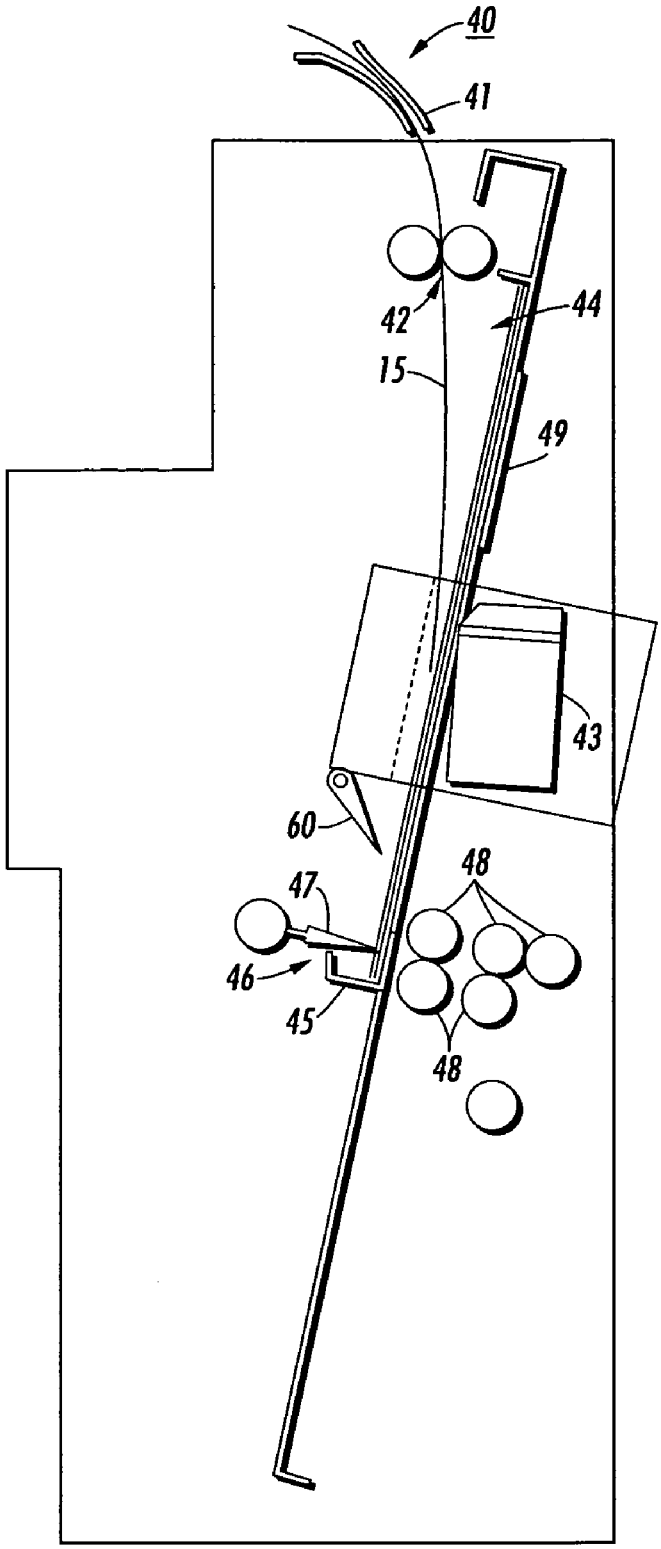
FIG. 5 is an elevation view showing sheets entering the booklet maker shown in of FIG. 1.
Figure 6:
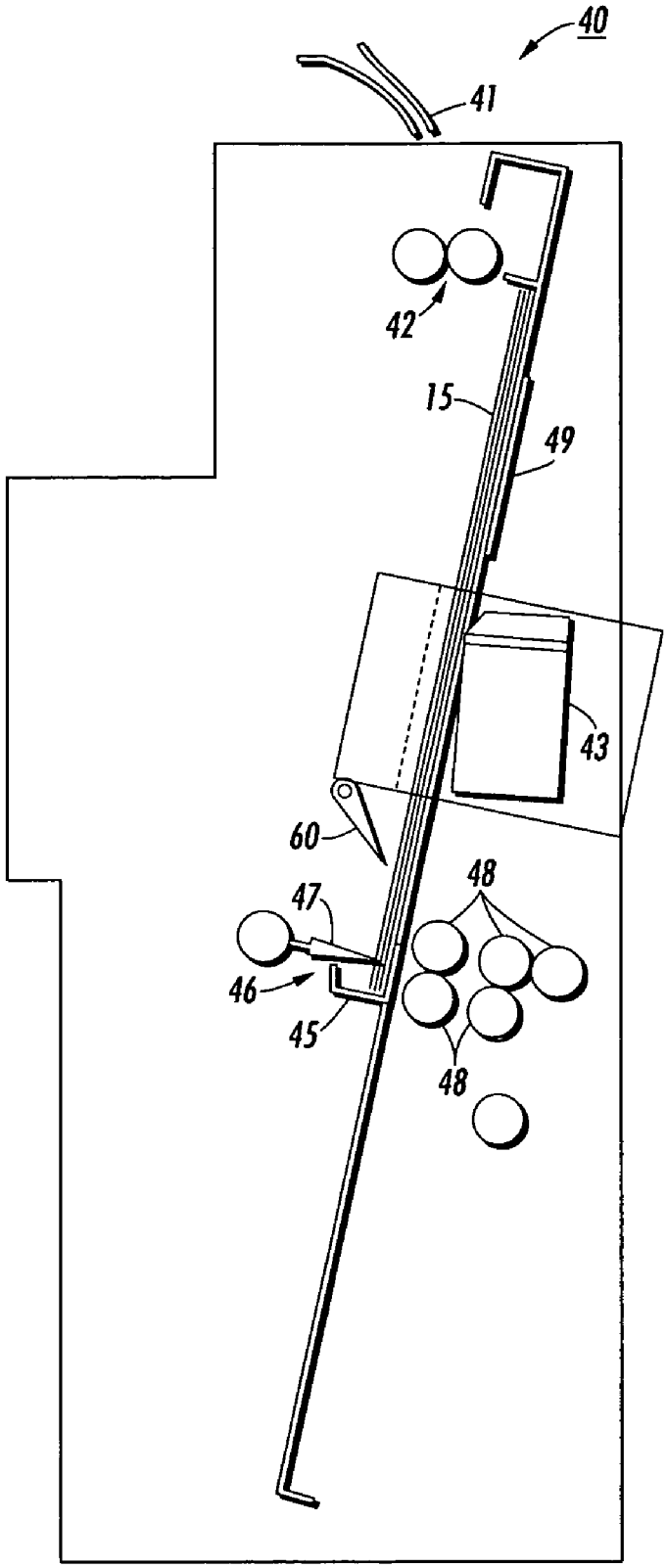
FIG. 6 is an elevation view of the booklet maker of FIG. 1 showing sheets compiled therein.

With booklet making as a requirement, folding and booklet maker 40 in FIGS. 5 and 6 defines an inlet baffle 41 that directs sheets 15 rotated 90° by sheet rotator 100 into drive nip 42. Drive nip 42 directs the sheets into an inclined compiling cavity 44 over which are positioned a stapler 43 and crease module 46. The trail edge of each sheet is controlled conventionally using either foam rolls or a sheet order gate (not shown). The signature sheets (each having four page images thereon, for eventual folding into pages of the booklet) are driven into the compiling cavity against a backstop 45. Backstop 45 is adapted to move relative to stapler 43 and crease module 46 and is used to position and control a compiled set of sheets for stapling and creasing. Sheets enter the compiling cavity 44 with the stapler and crease module in an upper position and a tamper 49 in a retracted position. Compiling continues until a set of sheets is accumulated and the lead edge of the last sheet of the set is acquired by backstop 45.

Figure 7:
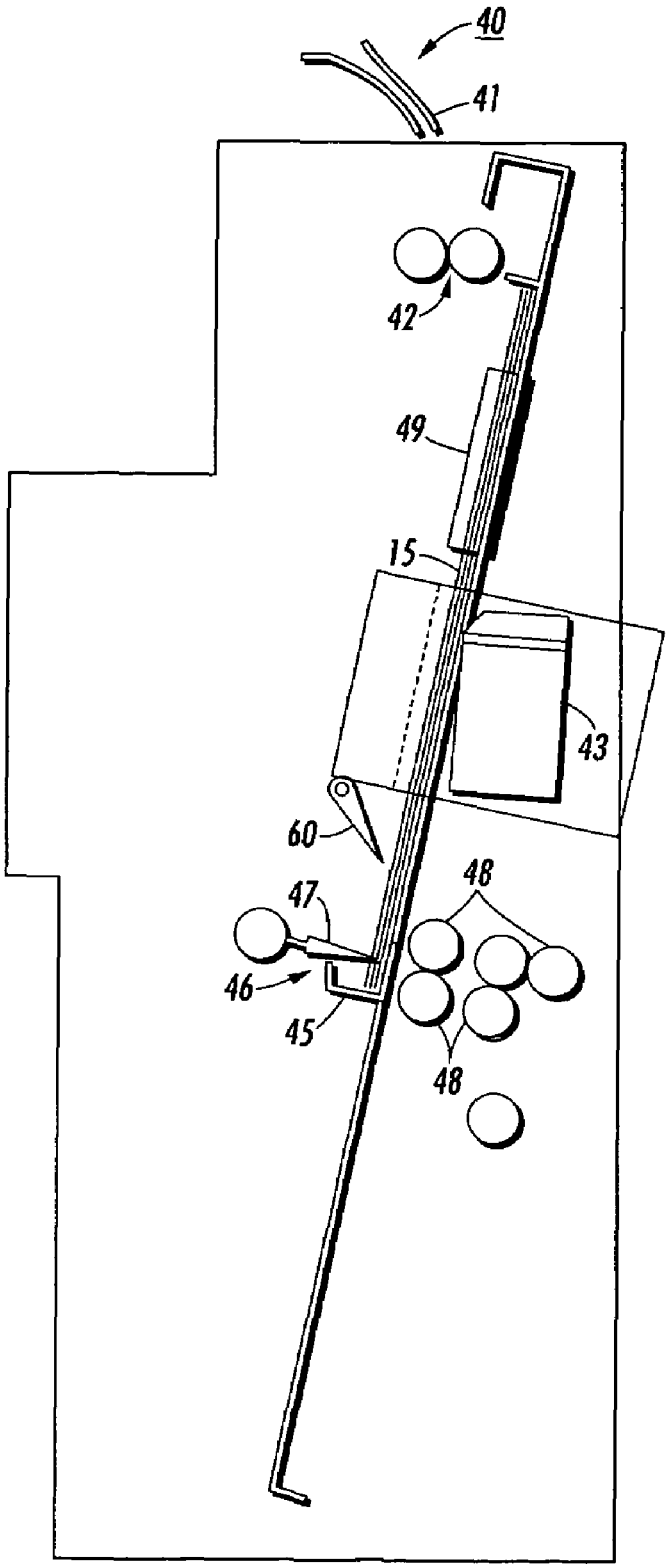
FIG. 7 is an elevation view of the booklet maker of FIG. 1 showing a backstop positioning the sheet set for stapling.
Figure 8:
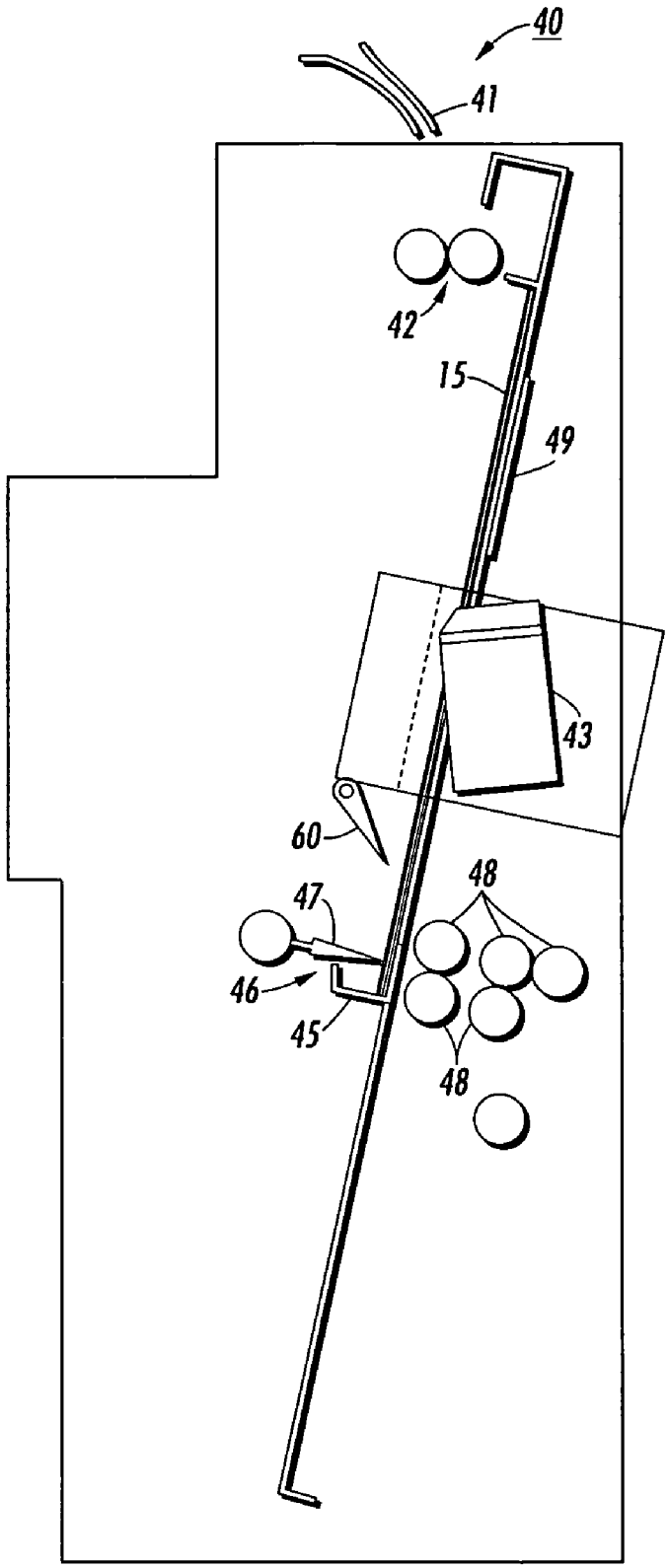
FIG. 8 is an elevation view of the booklet maker of FIG. 1 showing a stapler as it is fired.
Figure 9:
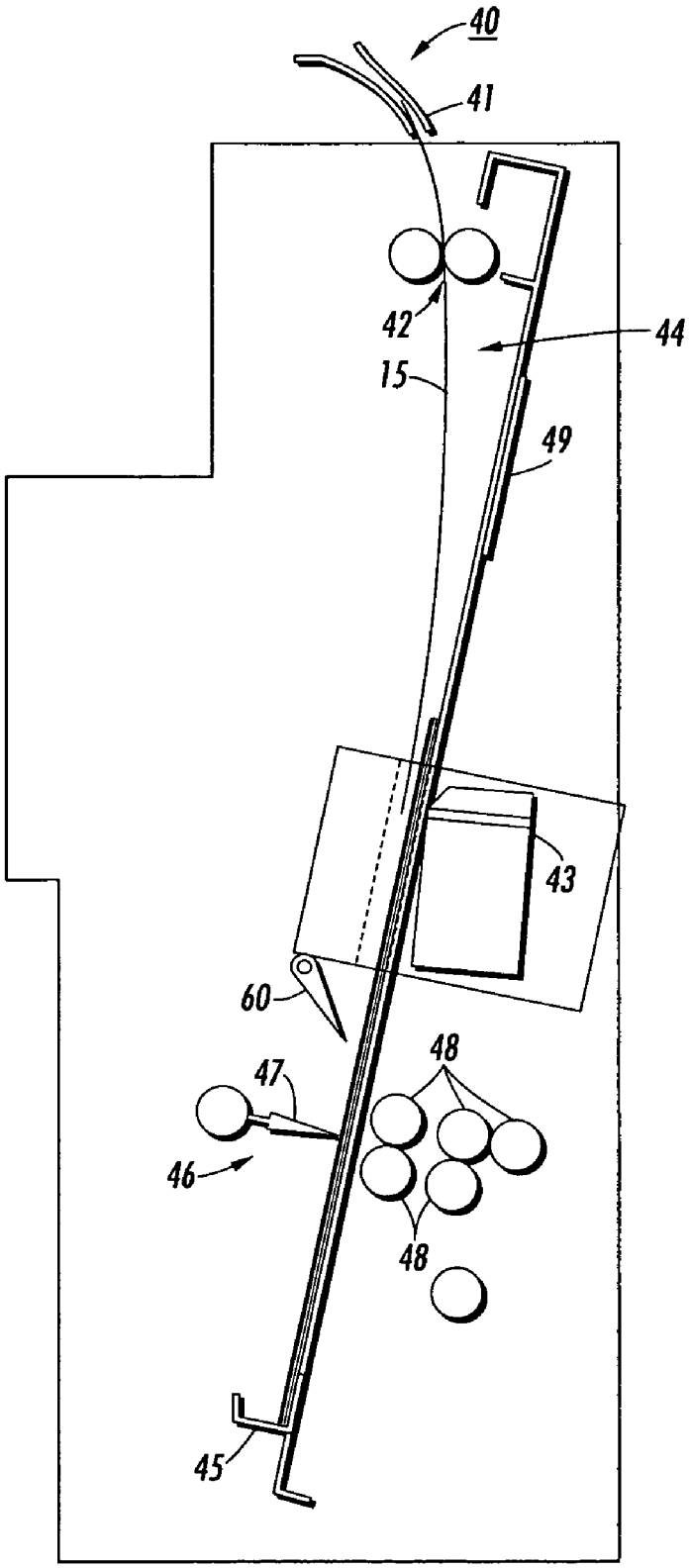
FIG. 9 is an elevation view of the booklet maker of FIG. 1 showing the backstop moved to a creasing position.

After a sheet set is accumulated in the cavity 44, as shown in FIG. 7, a tamper 49 is actuated to align the sheets for stapling and backstop 45 is moved by conventional means, such as, a rack and pinion mechanism or elevator movable (by means not shown, but typically including a motor or solenoid) to move the sheet set to a stapling position, while simultaneously, stapler 43 and crease module 46 are moved by similar conventional means (not shown) to a lower position. The sheet set is held by backstop 45 at a level where a stapler 43 can staple the sheets along a midline of the signatures, the midline corresponding to the eventual crease of the finished booklet. As shown in FIG. 8, at this time, stapler 43 fires to staple the sheet set and backstop 45 in FIG. 9 moves to the creasing position with the stapled sheet set. Sheets of a new set are simultaneously driven into the compiling cavity 44 with the now stapled sheet set serving to additionally dampen the incoming sheets. Stapler 43 moves separately from backstop 45 so that gate 60 is in the correct position relative to incoming sheets driven by drive nip 42.

Figure 10:
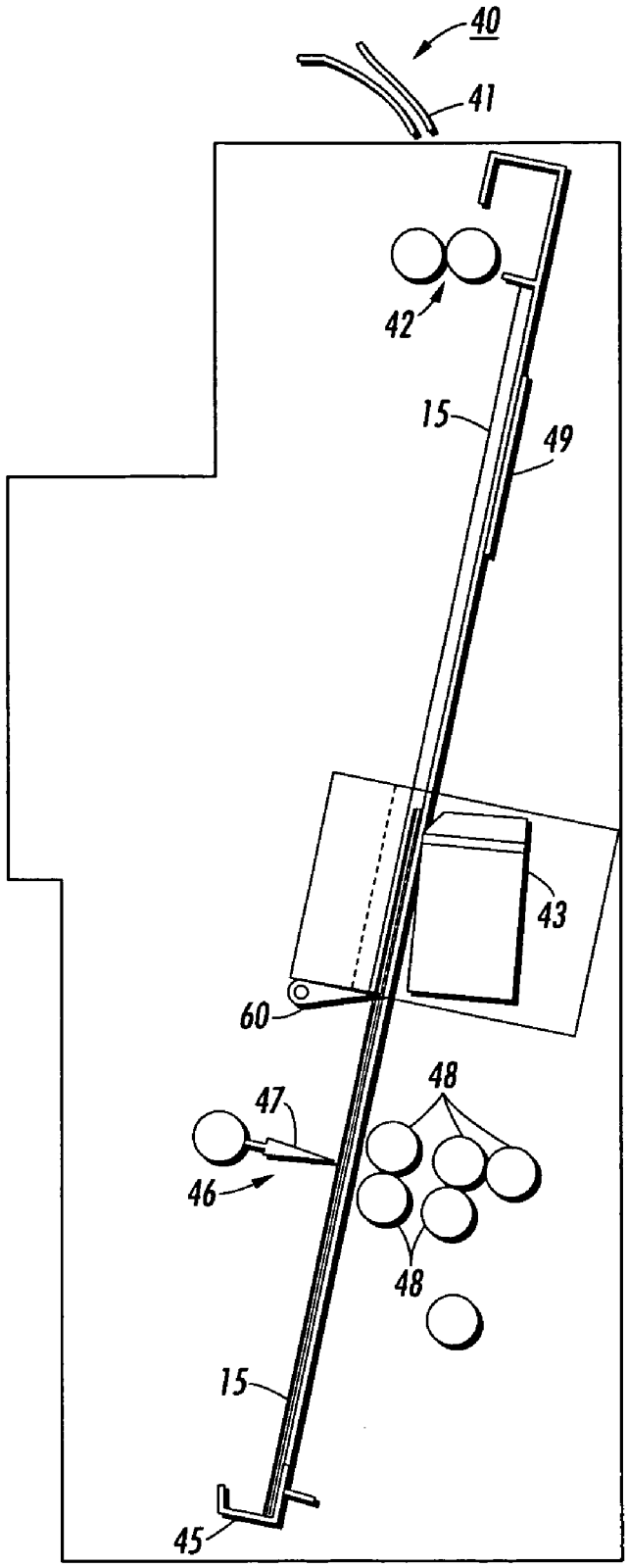
FIG. 10 is an elevation view of the booklet maker of FIG. 1 showing a gate acting as a backstop.
Figure 11:
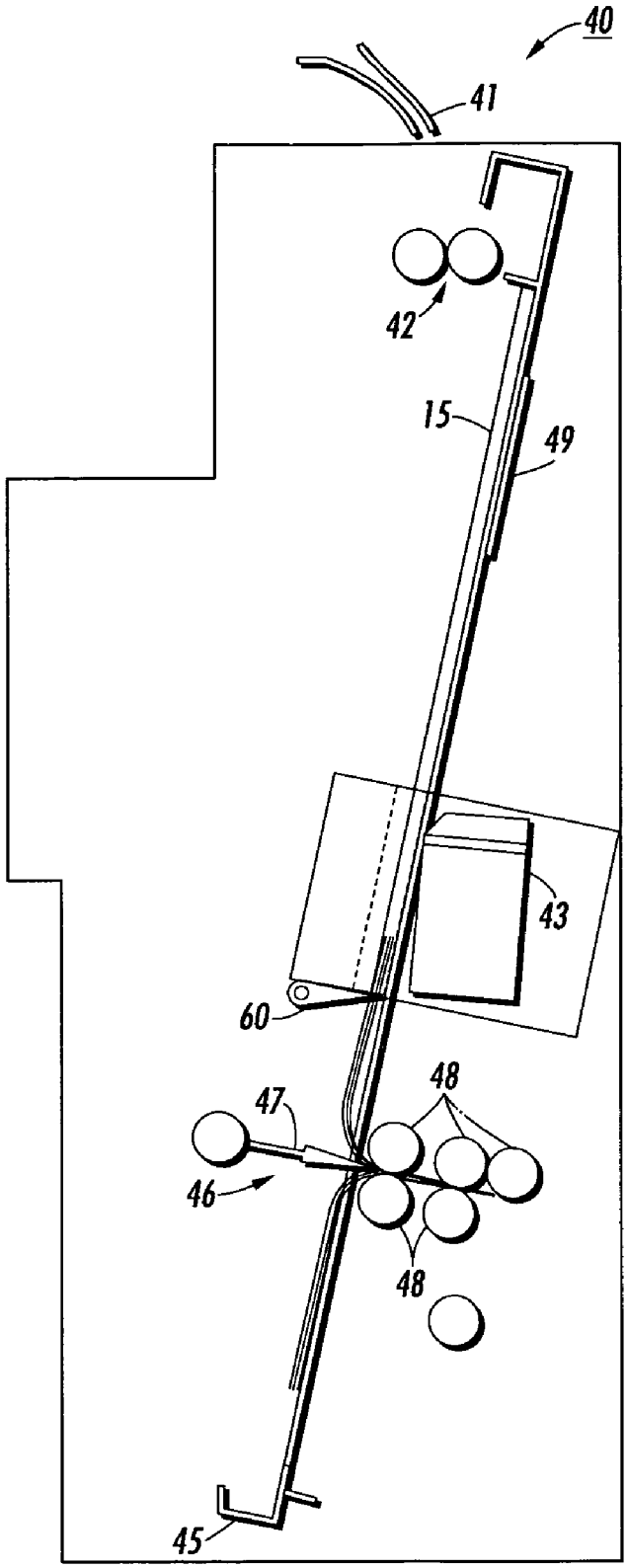
FIG. 11 is an elevation view of the booklet maker of FIG. 1 showing the set as it is creased.
Figure 12:
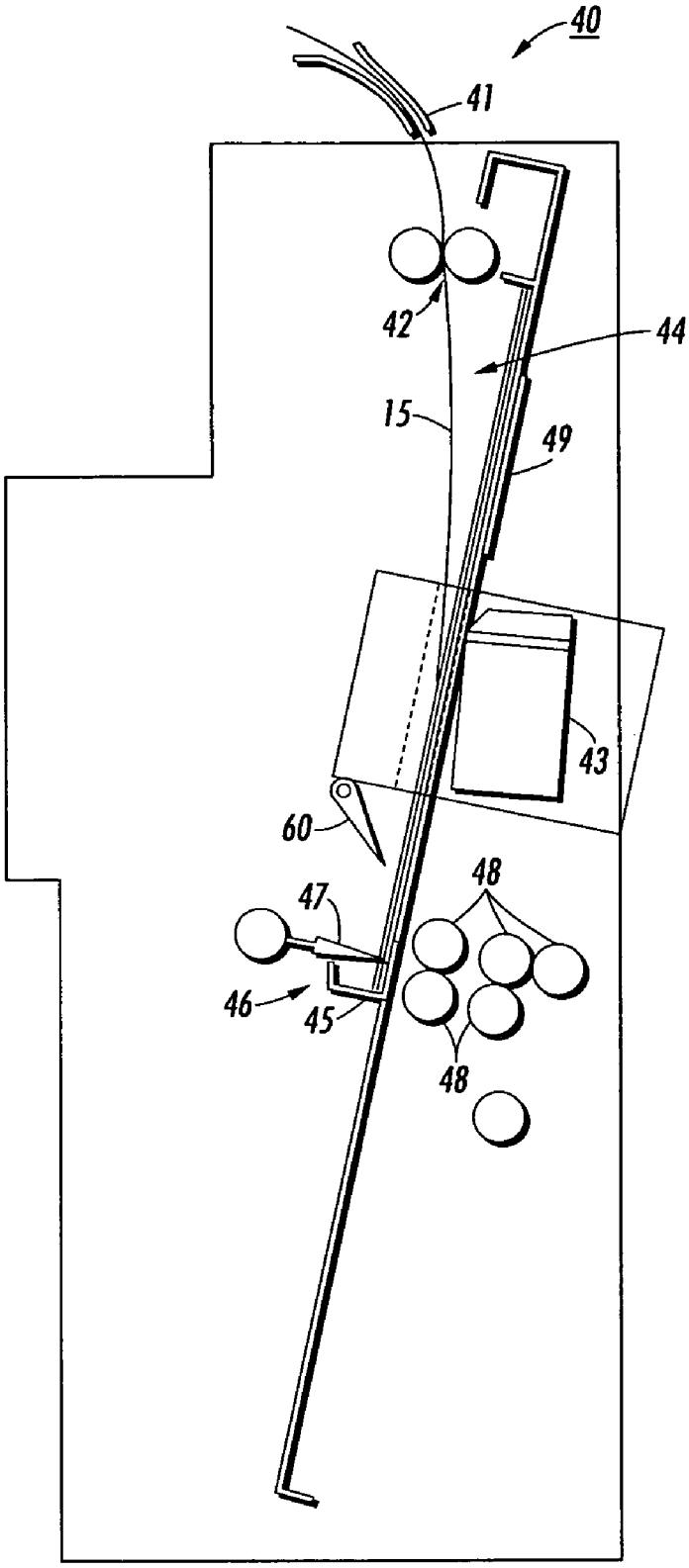
FIG. 12 is an elevation view of the booklet maker of FIG. 1 showing the backstop, stapler and crease module moved to an upper position.

Gate 60 is actuated, as shown in FIG. 10, to act as a temporary backstop for the new incoming sheet set and traps the lead edge of the incoming sheets. As the sheets of the incoming set are accumulating against gate 60, blade 47 of crease module 46 is actuated, as shown in FIG. 11. The action of blade 47 and crease rolls 48 perform the final folding, and sharp creasing, of the original sheet set into a finished booklet. Blade 47 contacts the sheet set along the stapled midpoint thereof, and bends the sheet set toward the nip of crease rolls 48, which draws all of the sheets in and forms a sharp crease. The crease and stapled sheet set is then drawn, by the rotation of crease rolls 48, completely through the nips, to form the final main fold in the finished booklet. The finished booklets are then collected in a stacker 70 as shown in FIG. 1. Subsequently, the incoming sheet set is gripped at the top to maintain its position by conventional means (not shown) while simultaneously, as shown in FIG. 12, gate 60 is deactuated and stapler 43 and crease module 46 are moved to the upper position. Backstop 45 is simultaneously moved upward as incoming sheets continue to be driven by nip 42 into the compiling tray. After backstop 45 has reached position to support the lead edge of the incoming set, the upper grip is released to allow incoming sheets to continue compiling.

It should now be understood that an improved sheet rotator has been disclosed that uses a vacuum/rotation mechanism to acquire and hold a sheet of paper and provide rotation for applications that require 90° rotation during feeding. A servo motor or similar device provides rotation to a vacuum assembly after the sheet has been acquired. This sheet rotator can be used with any device which handles documents and is particularly useful with printers and copiers when placed between a copier or printer and a finisher so that documents exiting the copier or printer can be properly orientated prior to entering the finishing apparatus. Letter size document which exit an upstream apparatus long edge first can be rotated 90° so that they enter, for example, a buckle folder, saddle stitcher, or direct mail system short edge first. Legal size (14") sheets can be rotated, if necessary, so that they are fed short edge first to third party devices which compile and dual staple sheet along their top edge. A3/11×17" sheets produced by signature producing devices can be rotated, if necessary, so that they are fed short edge first to enable saddle stitching and/or folding as disclosed in U.S. Pat. No. 4,727,402 which is incorporated herein by reference. It can also be used to achieve set distinction between a plurality of sets of documents by, for example, rotating alternate sets by 90°. A further example of use of the disclosed sheet rotator is with roll fed systems where the sheet rotator is placed rotate sheets after they have been cut from the roll, but before they enter a copier or printer.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A reprographic device including a predetermined paper path within which copy sheet are transported, comprising:

an image forming module for forming an image on a copy sheet in a sheet processing module;

a finishing module usable to compile and stack copy sheets from said image forming module; and a vacuum sheet rotator module positioned between said image forming module and said finishing module, said vacuum sheet rotator module including a vacuum capture port positioned in a center portion of said predetermined paper path to suction the center portion of sheets passing thereover, a vacuum source connected to said vacuum capture port and adapted to apply vacuum pressure to said vacuum capture port, and a rotatable disc surrounding said vacuum capture port with said rotatable disc comprising a single, impervious disc having a upper surface adapted to receive copy sheets directly thereagainst to be rotated, and wherein said rotatable disc is connected to a drive mechanism with said drive mechanism being connected to a servo motor to rotate said disc, said vacuum sheet rotator module being adapted to change orientation of copy sheets from portrait to landscape en route to said finishing module.

2. The reprographic device of claim 1, including sensors for sensing lead and trail edges of sheets after they have past said sheet rotator.

3. The reprographic device of claim 2, wherein said sensors include at least two lead edge sensors and one trail edge sensor.

4. The reprographic device of claim 3, including solenoid controlled nip release rolls.

5. A method for selectively rotating documents within a predetermined paper path in a printing apparatus, comprising:

providing an image forming apparatus for forming an image on a copy sheet in a sheet processing module;

providing a finishing module usable to compile and stack copy sheets from said image forming apparatus;

providing a vacuum sheet rotator positioned between said image forming apparatus and said finishing module, said vacuum sheet rotator module including a vacuum capture port positioned in a center portion of said predetermined paper path to suction the center portion of sheets passing thereover, a vacuum source connected to said vacuum capture port and adapted to apply vacuum pressure to said vacuum capture port, and a sole rotatable disc surrounding said vacuum capture port with said rotatable disc comprising a single, impervious disc having a upper surface adapted to receive copy sheets directly thereagainst to be rotated, and wherein said rotatable disc is connected to drive a mechanism with said drive mechanism being connected to a servo motor to rotate said disc, said sheet rotator being adapted to change orientation of copy sheets from portrait to landscape en route to said finishing module; and changing vacuum pressure to said vacuum capture port to accommodate various weights of copy sheets by dynamically sensing sheet rotation performance by sheet basis.

* * * * *